US008282312B2

(12) United States Patent
Braddy et al.

(10) Patent No.: US 8,282,312 B2
(45) Date of Patent: Oct. 9, 2012

(54) MACHINE SYSTEM OPERATION AND CONTROL STRATEGY FOR MATERIAL SUPPLY AND PLACEMENT

(75) Inventors: Katherine C. Braddy, Dunlap, IL (US); Dean R. Potts, Maple Grove, MN (US); Robert J. Price, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 747 days.

(21) Appl. No.: 12/319,610

(22) Filed: Jan. 9, 2009

(65) Prior Publication Data

US 2010/0178107 A1 Jul. 15, 2010

(51) Int. Cl.
*E01C 23/07* (2006.01)
*E01C 19/18* (2006.01)

(52) U.S. Cl. ..... 404/84.05; 404/108

(58) Field of Classification Search ..... 404/72, 404/84.05, 108; 701/50
See application file for complete search history.

(56) References Cited

U.S. PATENT DOCUMENTS

| | | | | |
|---|---|---|---|---|
| 3,356,261 | A | 12/1967 | Stein | |
| 3,693,512 | A | 9/1972 | Smith | |
| 4,818,139 | A * | 4/1989 | Brock et al. | 404/81 |
| 5,044,819 | A | 9/1991 | Kilheffer et al. | |
| 5,073,063 | A | 12/1991 | Brown | |
| 5,100,277 | A * | 3/1992 | Musil | 414/334 |
| 5,197,848 | A * | 3/1993 | Musil et al. | 414/809 |
| 5,220,876 | A | 6/1993 | Monson et al. | |
| 5,631,658 | A | 5/1997 | Gudat et al. | |
| 5,697,731 | A | 12/1997 | Bonds | |
| 5,865,563 | A * | 2/1999 | Bonds | 404/72 |
| 5,921,708 | A | 7/1999 | Grundl et al. | |
| 6,246,938 | B1 | 6/2001 | Giletta et al. | |
| 6,526,339 | B1 | 2/2003 | Herzog et al. | |
| 6,776,557 | B2 * | 8/2004 | Barnat et al. | 404/101 |
| 6,805,516 | B2 * | 10/2004 | Barnat et al. | 404/101 |
| 6,938,829 | B2 | 9/2005 | Doherty et al. | |
| 7,160,056 | B1 * | 1/2007 | Hoffmann et al. | 404/109 |
| 7,162,327 | B1 | 1/2007 | Crozier | |
| 7,284,929 | B2 * | 10/2007 | Schwenninger | 404/102 |
| 7,484,911 | B2 * | 2/2009 | Frelich | 404/75 |
| 7,798,744 | B2 * | 9/2010 | Larson et al. | 404/82 |
| 2006/0002762 | A1 | 1/2006 | Crampton | |
| 2006/0047377 | A1 | 3/2006 | Ferguson et al. | |
| 2008/0059411 | A1 | 3/2008 | Greiner et al. | |
| 2009/0103978 | A1 * | 4/2009 | Walker et al. | 404/72 |

OTHER PUBLICATIONS

Washington Asphalt Pavement Association; WAPA Asphalt Pavement Guide; published on the World Wide Web; prior to Jun. 13, 2008; pp. 1-3.

* cited by examiner

*Primary Examiner* — Thomas B Will
*Assistant Examiner* — Abigail A Risic
(74) *Attorney, Agent, or Firm* — Liell & McNeil

(57) ABSTRACT

A method of operating machine system includes receiving expected material placement data for a paving machine and comparing the expected material placement data with actual material placement data. The method further includes outputting a signal based on the comparison, and commanding replenishing material from a supply machine to the second supply volume responsive to the signal. A paving control system for a paving system includes a computer readable memory configured to store expected material placement data, a receiver configured to receive actual material placement data and a data processor configured to output a control signal to a supply machine to controllably replenish material to an external material supply volume for the paving system in a manner responsive to comparing the expected material placement data with the actual material replacement data.

19 Claims, 7 Drawing Sheets

MACHINE SYSTEM OPERATION AND CONTROL STRATEGY FOR MATERIAL SUPPLY AND PLACEMENT

TECHNICAL FIELD

The present disclosure relates generally to machine system operating and control strategies for supplying and placing material at a work site, and relates more particularly to controlling replenishing a material supply volume for the machine system responsive to a comparison between expected material placement data and actual material placement data.

BACKGROUND

In construction, road building and other industries, machine systems are often used to controllably place material to be used as a supporting substrate. In the context of paving roads, parking lots, etc., a paving machine is typically used to deposit and preliminarily compact a paving material which is later treated via one or more compacting machines to render a relatively hard, smooth traffic-bearing surface. A conventional paving machine includes a material storage hopper, a conveyor to transport material within the paving machine and a material placement mechanism such as a screed apparatus which controls a thickness and width of paving material deposited onto a work surface. For most jobs, the storage capacity of the hopper is insufficient to store all the paving material which will be placed by the paving machine. It is thus typically necessary to resupply the paving machine with material to be deposited such as asphalt, concrete or aggregate materials, periodically or continuously during operation.

To this end, many paving systems include supply machines which deposit material ahead of a paving machine on a surface to be paved. The paving machine may be equipped with or accompanied by a mechanism for loading the hopper with the material placed on the surface. One known system utilizes a mechanism known as a windrow elevator to elevate paving material deposited onto the surface in a windrow into the hopper of the paving machine. In other strategies, a machine known generally in the art as a material transfer vehicle will pick up loads of paving material deposited at a work site and shuttle the paving material to one or more paving machines, more or less on an as-needed basis.

It is generally desirable to avoid interruptions in paving material supply, but also generally desirable to avoid oversupplying paving material. In other words, to operate a paving system as efficiently as possible it is generally desirable to control the rate of supplying/resupplying paving material to a paving machine to avoid situations where paving progress stops because the machine runs out of material, and also to avoid situations where excess material is supplied. If excess material is supplied, then the storage capacity of the paving machine hopper may be exceeded. It may then be necessary to manually shovel excess material out of the paving machine hopper or remove material from a windrow to avoid overwhelming the paving machine and causing system down time. Likewise, it is typically desirable to avoid idling the paving machine by inadvertently halting material supply.

For the reasons explained above, it will be readily apparent that providing a consistent and accurate supply of paving material to a paving machine can be critical if paving is to progress at a theoretical optimum efficiency. In many instances, a paving machine operator or other personnel will be responsible for ordering the resupply of paving material to the paving machine. Paving material may be ordered based on visual observation of the material supply available, experience and, to a large extent, guesswork. In one conventional system, workers on the ground manually control depositing of paving material onto a work surface ahead of the paving machine. One problem with manual control strategies is that the personnel responsible for controlling a location and/or quantity of paving material deposited onto the work surface may not be capable of controlling the discharge amount or location of paving material with sufficient precision as to time, location or quantity to avoid oversupply or undersupply. Moreover, personnel responsible for controlling delivery and deposition of paving material on the work surface may not be privy to the actual volume of material needed, much less aberrations or changes in the rate of paving of the paving machine or the amount of material the paving machine is putting down. For example, during operation a paving machine may change paving width and paving thickness regularly. While an observer may make basic assumptions as to the rate at which paving material is being placed by the paving machine or a quantity of material required to pave a particular stretch of road, for instance, visual observation and experience are often insufficient to accurately determine how much material should be laid down ahead of a paving machine for pick-up. These and other confounding factors tend to compromise the efforts of even skilled site managers and machine operators to run a paving system at optimum efficiency.

United States Patent Application No. 2006/0002762 to Crampton is directed to a method and apparatus for spreading aggregate and road building materials onto a surface in relation to speed of a spreading machine. Crampton teaches a spreader assembly for controlled delivery of aggregate materials from a hopper to a surface. Crampton recognizes that some aspects of road quality can relate to depositing a measured and/or uniform amount of material. However, while Crampton may be suited to a certain type of machine system or paving strategy, Crampton is not concerned with nor applicable to supplying material for subsequent placement with a paving machine. Moreover, Crampton does not recognize the need or advantages to communicating certain types of data among machines of a complex system.

SUMMARY

In one aspect, a method of operating a machine system includes a step of receiving expected material placement data for a paving machine, the paving machine being adapted to receive material from a first supply volume external to the paving machine, transfer the material through a second supply volume internal to the paving machine and to place the material on a work surface via a material placing mechanism of the paving machine. The method further includes the steps of receiving actual material placement data for the paving machine, and outputting a signal based on a comparison between the expected material placement data and the actual material placement data. The method still further includes a step of commanding replenishing material from a supply machine to the second supply volume responsive to the signal.

In another aspect, a machine system includes a paving machine having a frame, a plurality of ground engaging elements, a hopper, a conveying mechanism and a material placing mechanism. The material placing mechanism is adapted to receive a material from the hopper via the conveying mechanism for placing the material on a work surface. The paving machine further includes an internal material supply volume for the machine system defined in part by the hopper and in part by the conveying mechanism. The machine system further includes a control system having a computer readable memory configured to store expected material placement data for the paving machine, and a receiver configured to receive actual material placement data for the paving machine. The control system further includes a data processor coupled with a computer readable memory and with the receiver. The data processor is configured to compare the expected material placement data with the actual material placement data, and further configured to output a supply machine control signal to control replenishing material via a supply machine to an external material supply volume for the paving system in a manner responsive to comparing the expected material placement data with the actual material placement data.

In still another aspect, a paving control system for a paving system includes a computer readable memory configured to store expected material placement data indicative of expected material placement by a paving machine, and a receiver configured to receive actual material placement data for the paving machine. The paving control system further includes a data processor coupled with the computer readable memory and with the receiver, the data processor being configured to compare the expected material placement data with the actual material placement data. The data processor is further configured to output a control signal to a supply machine to controllably replenish material to an external material supply volume for the paving system in a manner responsive to comparing the expected material placement data with the actual material placement data.

DETAILED DESCRIPTION

Figure 1:
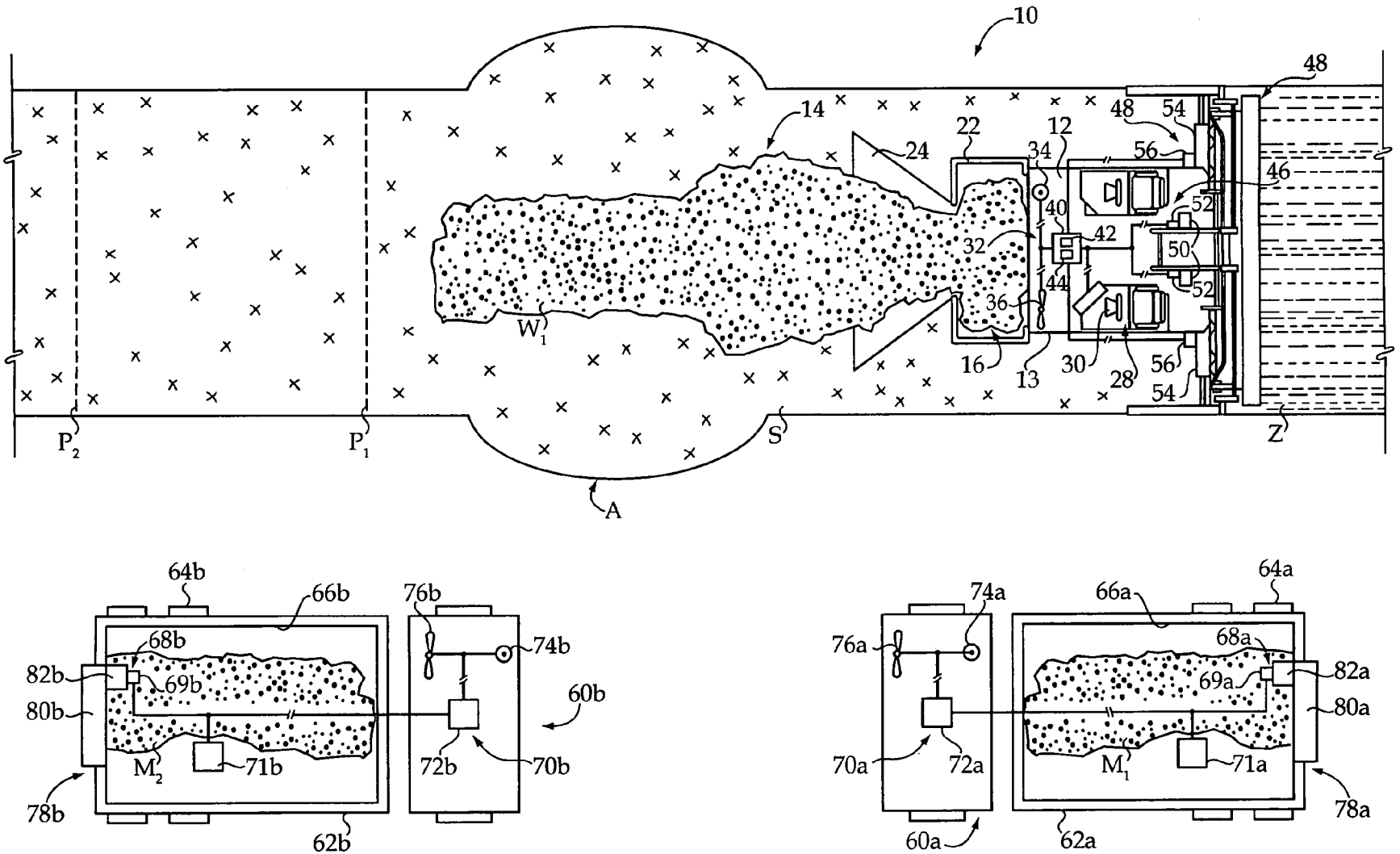
FIG. 1 is a diagrammatic illustration of a machine system at an operating stage, according to one embodiment.

Referring to FIG. 1, there is shown a paving system 10 according to one embodiment. Paving system 10 is shown as it might appear at one stage of paving a work surface "S" with a mat of paving material "Z" via a paving machine 12. Paving machine 12 is illustrated loading material from a windrow $W_1$ during paving. A first section of surface S has been paved with mat Z as shown, and a subsequent section is yet to be paved. Also shown in FIG. 1 are a plurality of supply machines of machine system 10, including a first supply machine 60*a* and a second supply machine 60*b*. Each of supply machines 60*a* and 60*b* may include a frame 62*a*, 62*b*, and a set of ground engaging elements 64*a*, 64*b*, mounted to frame 62*a*, 62*b*. Each of supply machines 60*a* and 60*b* may further include a material storage container 66*a*, 66*b* for storing and transporting a material such as a paving material about a work site for supplying to one or more paving machines of paving system 10. Supply machine 60*a* is shown storing an on-board material load $M_1$ whereas supply machine 60*b* stores a relatively smaller on-board material load $M_2$. In one embodiment, supply machines 60*a* and 60*b* may be used to periodically supply a paving material to work surface S for pick-up via paving machine 12, and eventual use in paving mat Z. Supply machines 60*a* and 60*b* may also periodically travel to an asphalt plant to obtain additional paving material as needed. In FIG. 1, a first windrow start location $P_1$ and a second windrow start location $P_2$ are shown. In one embodiment, start location $P_1$ represents a preliminarily planned windrow start location corresponding to a preliminary material supply/delivery plan for machine system 10. Start location $P_2$ represents a different, or updated, start location which may be selected if the initially planned start location $P_1$ is determined to be inappropriate. The significance of start locations $P_1$ and $P_2$ will be further apparent from the following description. Rather than depositing material in a windrow for pick-up by paving machine 10, in certain embodiments the teachings set forth herein may also be applied to strategies using one or more material transfer vehicles to supply paving machine 12, and such other paving machines as might be a part of machine system 10. As further described herein, by gathering certain data and communicating among the various machines of machine system 10, paving machine 12 will be capable of paving mat Z while reducing any risk of halting operation due to interrupted or excessive material supply.

Paving machine 12 may further include a frame 13 which includes a hopper 22 configured to store paving material for supplying to a material placing mechanism 18 such as a screed assembly of paving machine 12. Paving machine 12 may further be configured to pick up paving material from windrow $W_1$ via a windrow elevator 24. Supply machines 60*a* and 60*b* may each be configured to place material on work surface S in a controlled fashion to replenish windrow $W_1$ and/or start a new windrow. In one embodiment, windrow elevator 24 may be coupled with frame 13 and may extend forwardly thereof to allow paving material to be elevated from windrow $W_1$ into hopper 22 in a conventional manner. Windrow elevator 24 might include augers, conveyors or the like (not shown) for this purpose. As mentioned above, rather than using a windrow elevator 24, a separate machine such as a material transfer vehicle might be used for supplying paving material from a storage location to paving machine 12. In many instances, paving system 10 may be used for paving surface S via an asphalt material including a mixture of aggregates and petroleum products, well known in the art. In other embodiments, rather than an asphalt material, "paving" material as described herein might be an aggregate material, a concrete material for subsequent roller compaction, or still another material. It should thus be appreciated that the present disclosure is not strictly limited to paving or placing a material of any particular composition. In any event, windrow $W_1$ may include a first supply volume or "external" supply volume 14 and paving machine 12 may be configured to receive material from the first supply volume 14, transfer material through a second supply volume internal to paving machine 12 and place the material on work surface S via material placing mechanism 18.

Paving machine 12 may further include a plurality of ground engaging elements 26 such as ground engaging tracks, wheels or the like, for propelling paving machine 12 along work surface S. In one embodiment, material placing mechanism 18 may include a screed as mentioned above. Material placing mechanism 18 may further include a width adjustable screed having a set of screed width actuators 54, and may also include a set of screed height actuators 50. Paving machine 12 may further include a control system 32 whereby paving machine 12 monitors a variety of operating parameters of paving system 10, and controls various operations of paving machine 12 and supply machines 60*a* and 60*b*, as further described herein.

Figure 2:
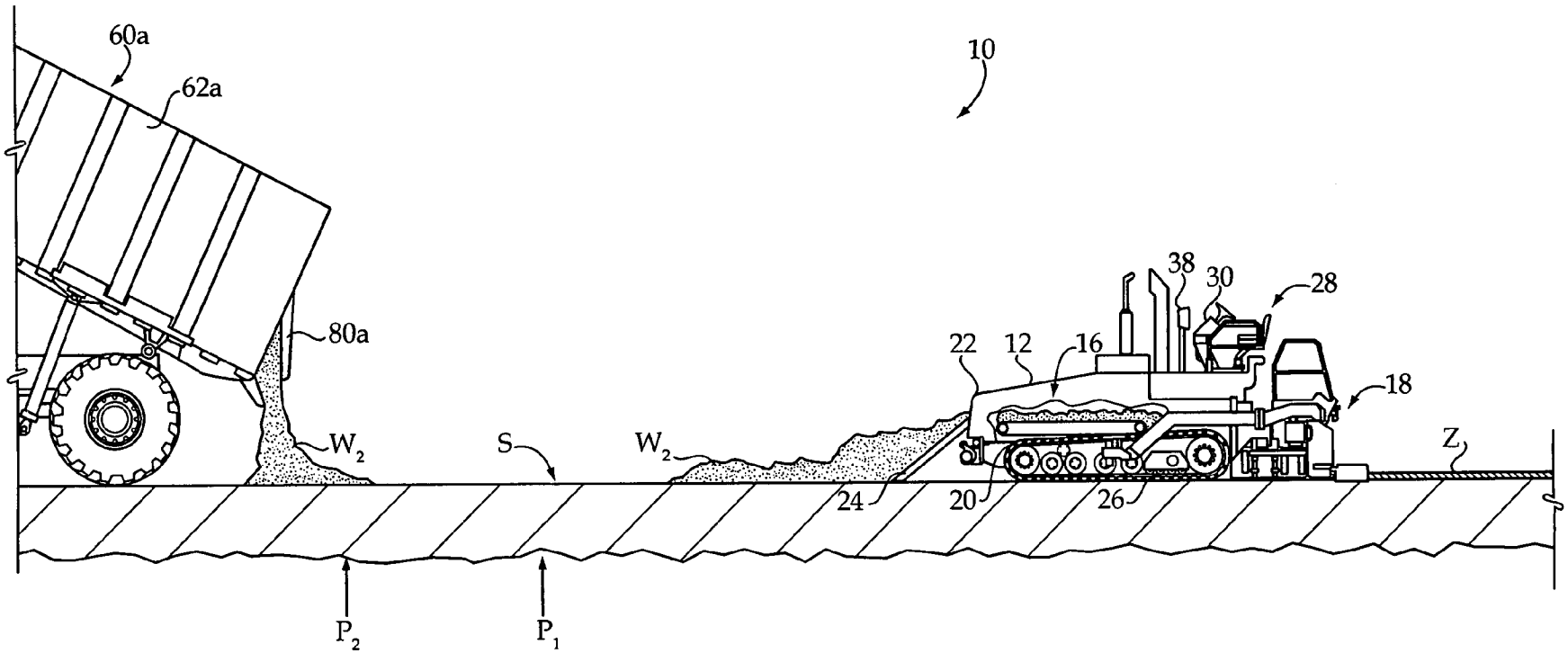
FIG. 2 is a side diagrammatic illustration of the machine system of FIG. 1 at another operating stage.
Figure 3A:
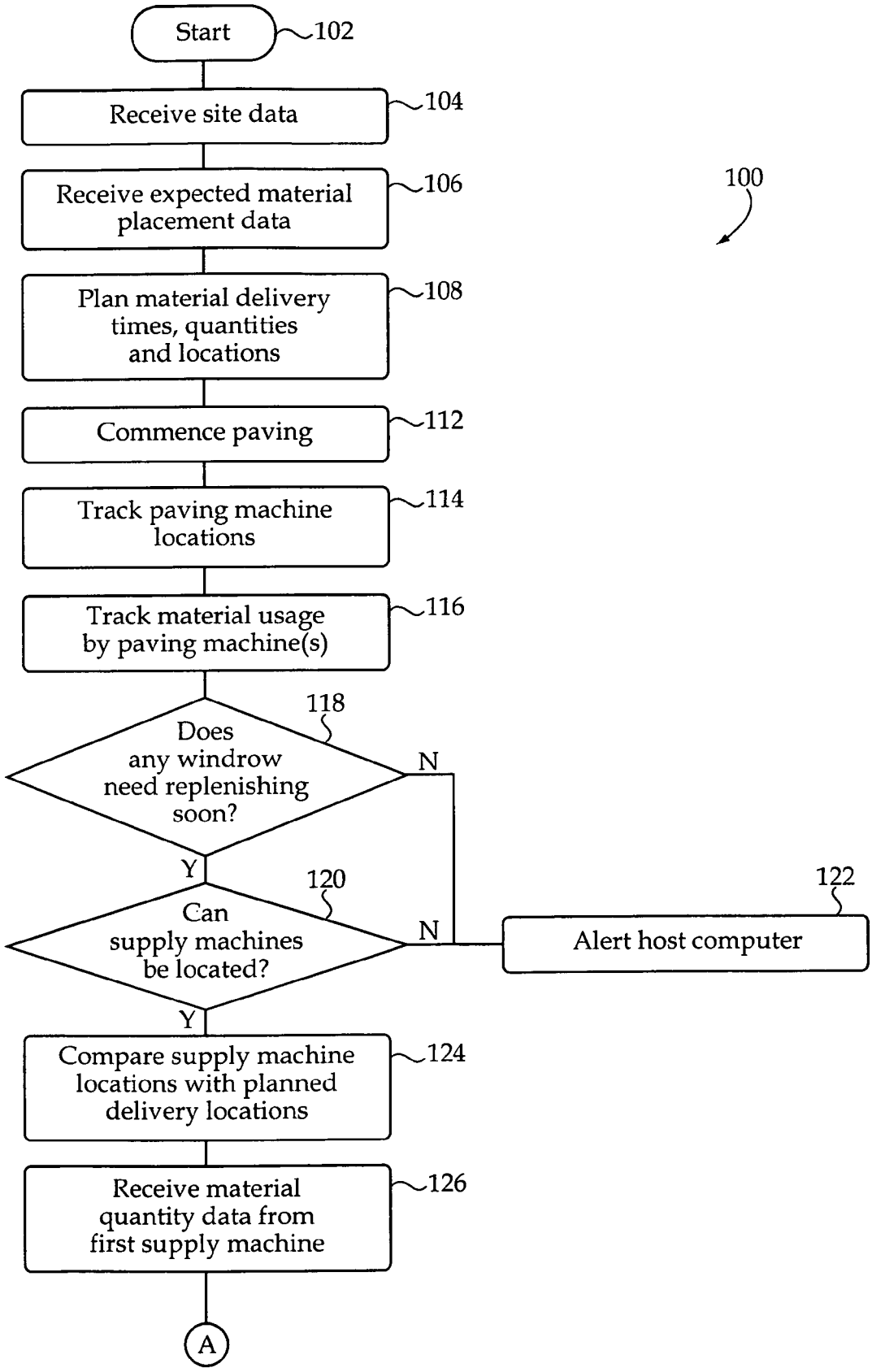
FIG. 3*a* is a flowchart illustrating a portion of a control process for a machine system, according to one embodiment.
Figure 3B:
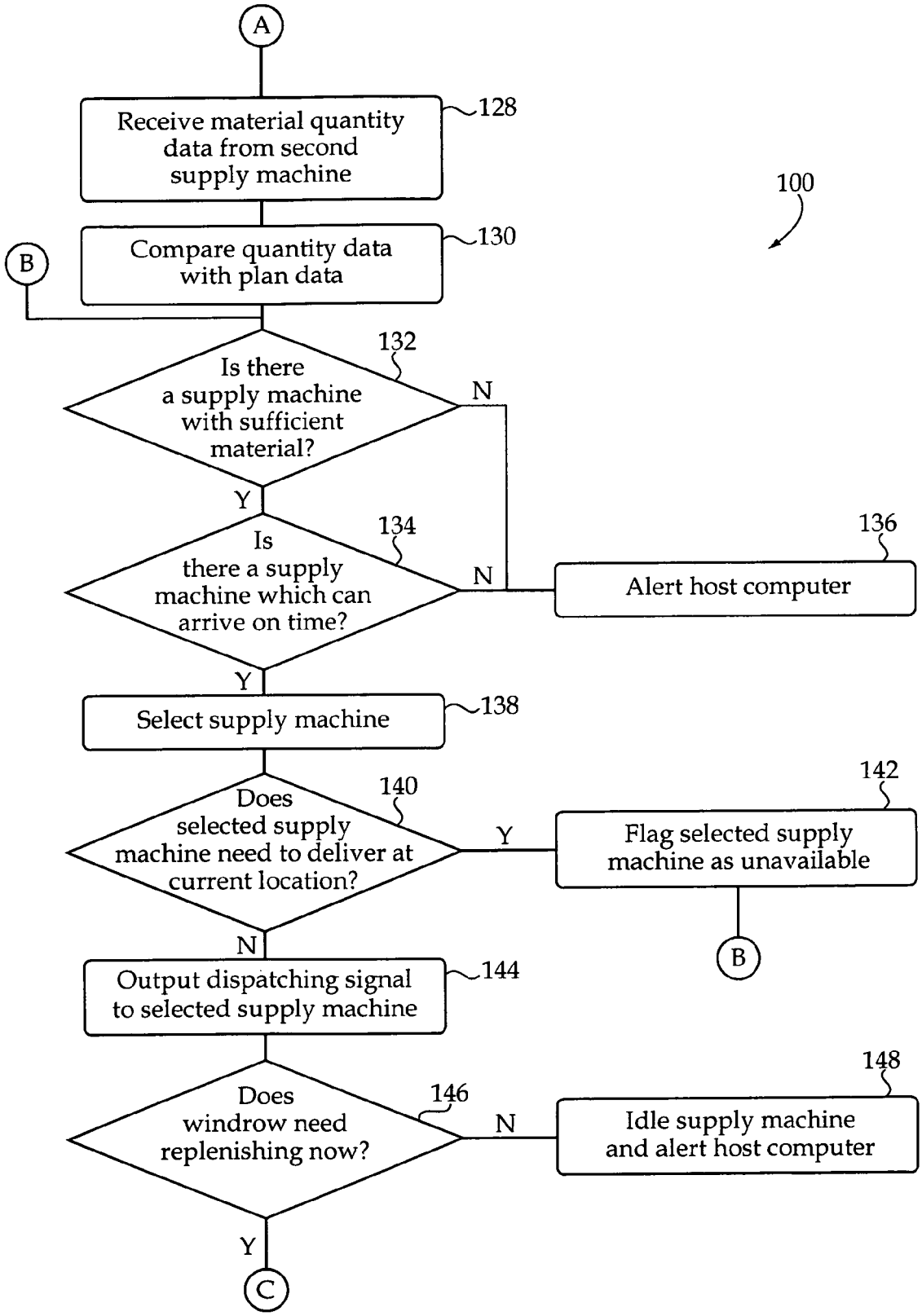
FIG. 3*b* is a flowchart illustrating another portion of the control process for a machine system.
Figure 3C:
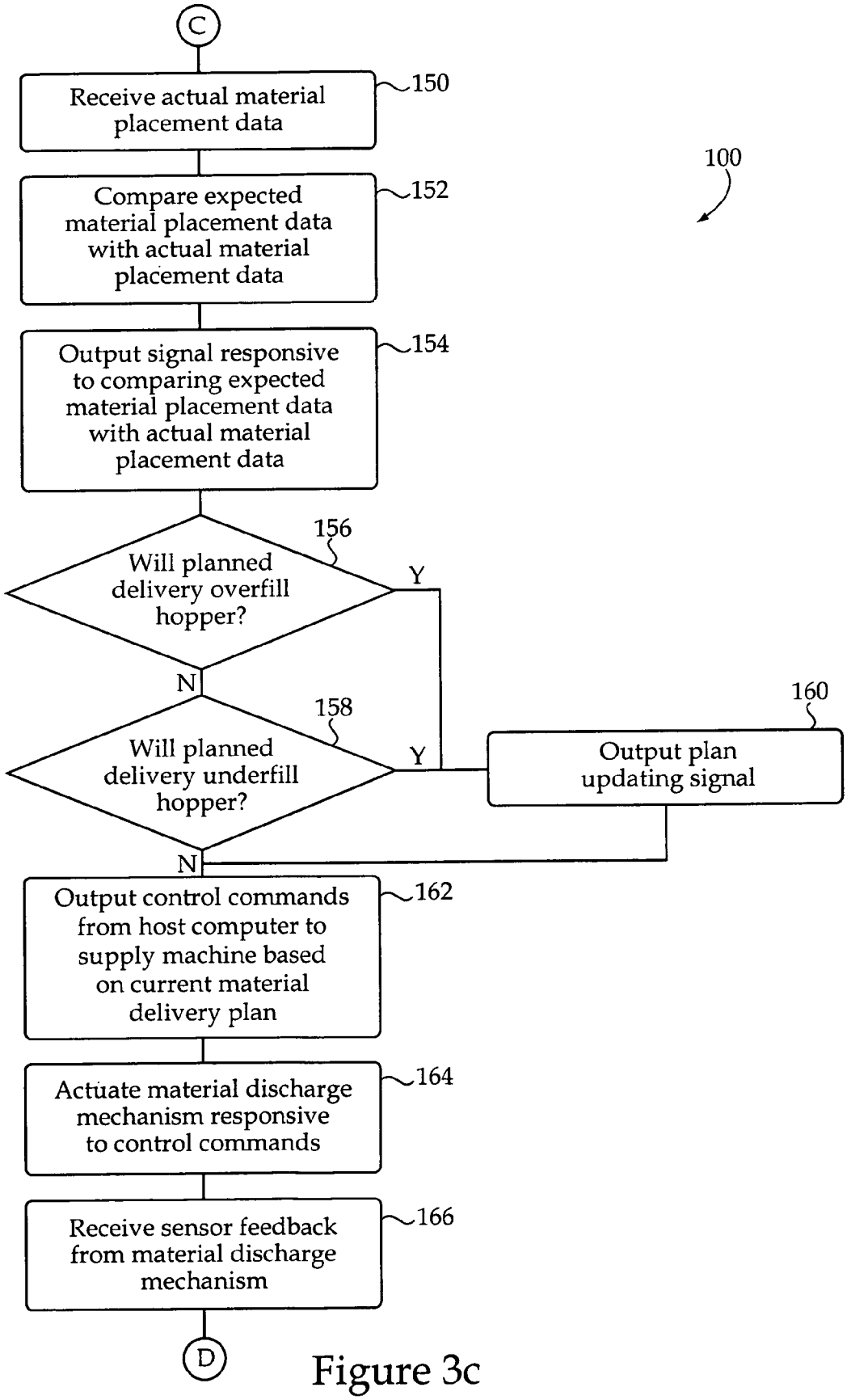
FIG. 3*c* is a flowchart illustrating yet another portion of the control process for a machine system.
Figure 3D:
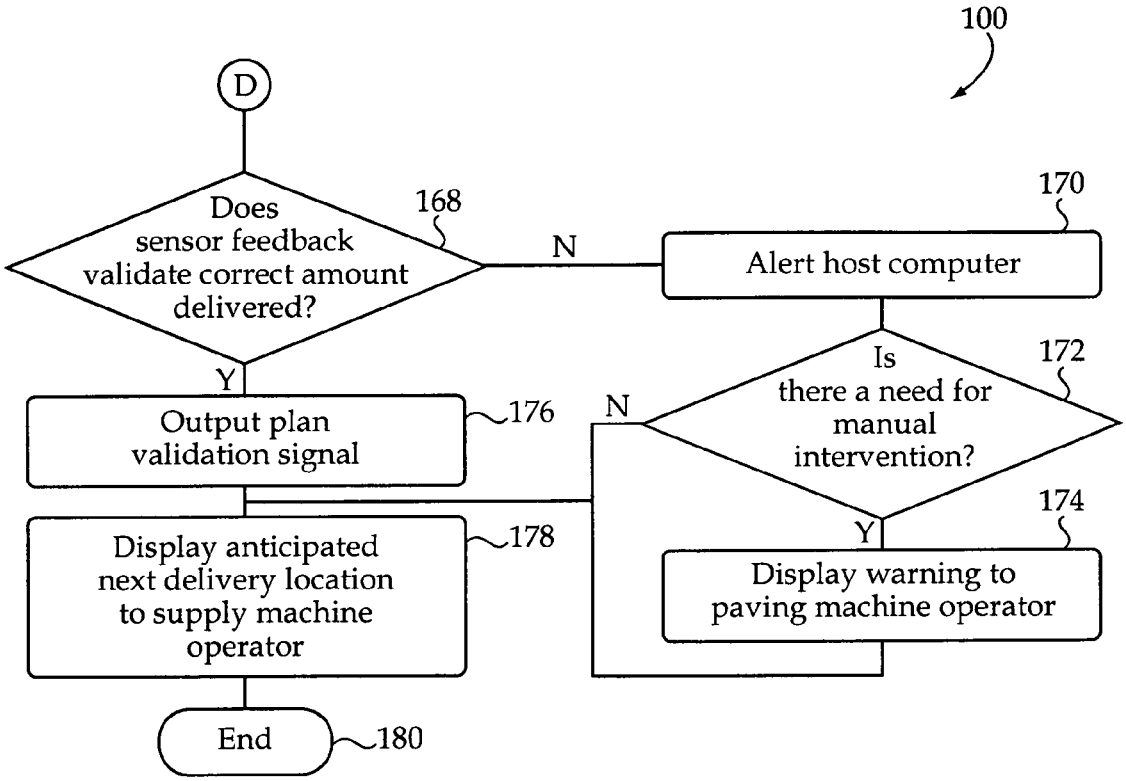
FIG. 3*d* is a flowchart illustrating yet another portion of the control process for a machine system.

Referring also to FIG. 2, there are shown additional features of paving system 10 and paving machine 12, with paving machine 12 shown having progressed slightly ahead of the position depicted in FIG. 1. Supply machine 60*a* has been dispatched to replenish supply volume 14, such as by starting a new windrow $W_2$ at windrow start location $P_2$ instead of $P_1$, for reasons further explained herein. Paving machine 12 may further include a conveyor 20 as shown in FIG. 2 adapted to convey paving material from hopper 22 to material placing mechanism 18 in a conventional manner. Hopper 22 and conveyor 20 may define at least in part a second supply volume 16 or "internal" supply volume, as mentioned above. Thus, supply volume 14 and supply volume 16 may together include a total amount of material presently available for use by paving machine 12.

Returning to FIG. 1, it may be noted that paving machine 12 may be picking up and loading material continuously into hopper 22 so long as paving machine 12 is interacting with a windrow. If a paving machine is receiving material from an external supply volume such as a windrow faster than the paving machine is placing material on a surface, then material in the machine's internal supply volume will increase in quantity. Similarly, if a paving machine is placing material faster than it is receiving material, then the material in the machine's internal supply volume will decrease in quantity. If the subject paving machine continues to operate with a supply/placement disparity, then eventually its hopper will either overflow or become empty. In either case, operation is halted to remedy the situation. Paving machines are typically equipped with a sufficiently large internal supply volume that the machine can tolerate a supply/placement disparity for some time. If operation with a supply/placement disparity continues, however, the paving machine will eventually have to stop operating. By way of the automated material supply and material placement feedback mechanisms further described herein, the present disclosure may be understood as enhancing the ability of a paving machine, and an overall paving system, to accommodate supply/placement disparities. A total material supply volume presently available for use by paving machine 12, including external supply volume 14 and internal supply volume 16, will tend to be matched relatively more closely to an actual need for material than in conventional systems. Accordingly, when supply/placement disparity does occur, a paving machine such as paving machine 12 will tend to be more likely to have available internal supply volume to accommodate surges in material supply, surges in material placement, or reductions in material supply or material placement.

In FIG. 1, a subsection of surface S, identified via reference letter "T", includes an enlarged width relative to other subsections of surface S. It may be expected that paving machine 10 will place a relatively greater amount of material in subsection T than on other sections of surface S. To accommodate an increase in material demand by paving machine 10 to pave the relatively wide subsection T, a portion of windrow $W_1$ is slightly enlarged beginning prior to subsection T. In a real world example, windrow $W_1$ may or may not be enlarged as shown, however, as will be further apparent from the following description, tailoring windrow height and/or width based on expected material demand and actual material usage by paving machine 12 is contemplated to be one practical implementation of the present disclosure. In certain instances, a windrow might change regularly in cross sectional area to accommodate expected changes in paving material demand from paving machine 10. It should be appreciated, however, that the improved efficiency goals of the present disclosure may be realized without tailoring windrow size or shape, such as by controlling windrow start locations and windrow stop locations, and thus FIG. 1 is purely illustrative. In the present context, windrow size or shape may be understood as a mass quantity profile of a windrow. In any event, however, it will be appreciated for reasons further described herein that machine system 10 and paving machine 12 are uniquely configured as compared to state of the art systems to efficiently and automatically control placement of material for supplying paving machine 10 based on expected material demand and actual material usage. This contrasts with earlier systems where experience and visual observation provided essentially the sole means for controlling material placement in a paving system.

Control system 32 may further include an electronic control unit 40 configured by way of software and/or hardware control to implement an operating method for machine system 10 according to the present disclosure. Electronic control unit 40 may be resident on paving machine 12 in one embodiment, and may include a host computer for monitoring and controlling machine system 10. In another embodiment, a host computer of machine system 10/control system 32 could be positioned on another of the machines of machine system 10, or at a site management office or the like. Electronic control unit 32 may include a computer readable memory 44 such as RAM, ROM, flash memory or another suitable type of memory and a data processor 42 in communication with computer readable memory 44. Control system 32 may further include a display 38 viewable by an operator at an operator station 28 and being configured to display information for controlling and/or monitoring machine system 10 to an operator, as further described herein. Operator station 28 may be one of two operator stations for paving machine 12, however, only a single operator station is illustrated and described herein.

Electronic control unit 40 may be in communication with a set of screed control sensors of control system 32, including for example screed height sensors 52 which are coupled with screed height actuators 50. Control system 32 may further include additional screed control sensors such as a set of screed width sensors 56 coupled with screed width actuators 54 and in communication with electronic control unit 40. Screed height sensors 52 and screed width sensors 56 may be part of a sensing system 46 for communicating actual material placement data to electronic control unit 40. In one embodiment, sensing system 46 may output sensor signals to electronic control unit 40 which are indicative of a width and thickness of mat Z. Sensing system 46 might also include a speed sensor (not shown) monitoring a speed of conveyor 20, a ground speed sensor (not shown) monitoring a ground speed of paving machine 12 or a weight sensor (not shown) monitoring a weight of material in hopper 22. A history of sensor signals from sensing system 46 may be used to determine or estimate a quantity of material placed by paving machine 12 during paving mat Z and/or to determine or estimate a rate at which material is being placed by paving machine 12. For example, if screed assembly 18 is positioned at height "X" and width "Y" for "N" seconds at a ground speed of "G" meters per second, a total quantity of material placed by paving machine 12 in a given length of time or a rate of placing material with paving machine 12 can be estimated. Monitoring some or all of the other listed parameters such as conveyor speed or material weight could also be used to calculate or further refine estimates or determinations of material placement quantity or material placement rate with paving machine 12.

Control system 32 may further include a transmitter 34 configured to output control signals to other machines of paving system 10 such as supply machines 60*a* and 60*b*. Control system 32 may also include a receiver 36 configured to receive data such as paving machine position data indicative of a position of paving machine 12 relative to a reference position. Global or local positioning may be used. Receiver 36 may also be configured to receive data from other machines of paving system 10 such as supply machines 60*a* and 60*b*, as further described herein. Where electronic control unit 40 is resident on paving machine 12, electronic control unit 40 may itself be considered a receiver configured to receive material placement data as described herein from sensing system 46.

Each of supply machines 60*a* and 60*b* may further include a sensing system 68*a*, 68*b* resident thereon, which is adapted to monitor various operating parameters of supply machines 60*a* and 60*b* such as on-board material quantity stored in material storage containers 66*a*, 66*b* via a sensor 71*a*, 71*b* such as a weight sensor. Sensing systems 68*a* and 68*b* may also each include another sensor 69*a*, 69*b* adapted to sense a parameter indicative of a material discharge quantity when material is placed via the corresponding machine to replenish windrow $W_1$. Each of supply machines 60*a* and 60*b* may further include a control system 70*a* and 70*b*, respectively, which is resident thereon and configured to communicate as further described herein with control system 32 of paving machine 12. Each control system 70*a* and 70*b* may include an electronic control unit 72*a*, 72*b* which is in communication with a receiver 76*a*, 76*b* and a transmitter 74*a*, 74*b*. Each sensing system 68*a* and 68*b* may be adapted to communicate with the corresponding electronic control unit 72*a* or 72*b*, which may output signals via transmitters 74*a* and 74*b*, respectively, to control system 32 of paving machine 12. In one embodiment, the outputted signals may include sensor signals which are indicative of a material quantity stored within the corresponding storage containers 66*a* and 66*b*. The outputted signals may also include material discharge data based on sensor input from sensing systems 68*a* and 68*b* which are indicative of a quantity of material discharged by the corresponding supply machine 60*a*, 60*b*, as described herein. Each of supply machines 60*a* and 60*b* may also include a receiver 76*a* and 76*b*, respectively, adapted to receive supply machine control signals output via transmitter 34 of paving machine 12. Receivers 76*a* and 76*b* may also be configured to receive position signals indicative of a position of the corresponding supply machine 60*a* and 60*b*.

Each of supply machines 60*a* and 60*b* may further be configured to replenish windrow $W_1$, or deposit an additional windrow, via controllably discharging paving material from the corresponding storage container 66*a* and 66*b* onto work surface S. To this end, each of supply machines 60*a* and 60*b* may be equipped with a material discharge control mechanism 78*a*, 78*b* which is configured to control opening, closing and position of a control gate 80*a* and 80*b*. Each discharge control mechanism 78*a* and 78*b* may further include a gate actuator 82*a*, 82*b* coupled with the corresponding gate 80*a* and 80*b*. A gate control sensor 69*a* and 69*b* may be coupled with a corresponding gate actuator 82*a* and 82*b* and configured to output sensor signals indicative of a position of the corresponding gate actuator 82*a* and 82*b*. The sensor signals output via gate control sensors 69*a*, 69*b* may include material discharge quantity data as mentioned above, since a position history of gate 80*a* and 80*b* during a material discharge cycle may be indicative of a material discharge quantity discharged via supply machines 60*a* and 60*b* when replenishing supply volume 14. Sensor data from sensors 71*b* and 71*a* might also comprise the material discharge data.

As discussed above, electronic control unit 40 may serve as a host computer for monitoring and controlling activities of machine system 10. To this end, computer readable memory 44 may store a material supply control algorithm which includes computer executable code thereon. Electronic control unit 40 may be configured via data processor 42 to execute the material supply control algorithm to control placing material in a windrow on work surface S with one or both of supply machines 60*a* and 60*b* for pick-up by or delivery to paving machine 12. The material supply control algorithm may include an actual material placement term corresponding to actual material placement data received from sensing system 46 as described herein. The material supply control algorithm may further include a material discharge term corresponding to material discharge quantity data received from sensing systems 68*a* and 68*b* as described herein. The material supply control algorithm may further include a paving machine position term and a supply machine position term, corresponding to paving machine position data and supply machine position data as described herein. Electronic control unit 40 may be configured via data processor 42 to output a supply machine control signal responsive to a position of paving machine 12, responsive to a position of supply machine(s) 60*a*, 60*b*, and responsive to comparing the actual material placement data with expected material placement data for paving machine 12, as further described herein. Execution of the subject control algorithm will be further understood by way of the description of an example control process executed via electronic control unit 40 as set forth below.

INDUSTRIAL APPLICABILITY

Referring to FIGS. 3*a-d*, there is shown a flowchart 100 illustrating an example control process according to the present disclosure. The process of flowchart 100 may start at step 102. From step 102, the process may proceed to step 104 to receive site data. The site data may include data specific to a particular work site, including but not limited to an area to be paved, an average lift thickness of material to be used during paving, an approximate distance expected to exist between different paving machines operating at the work site, a distance between a work site and an asphalt plant, if applicable, etc. The site data may also include data specific to the particular paving system being used, such as a number of paving machines which will be working, machine travel/paving speeds, a number of supply machines which are available for replenishing material to the paving machines, etc. From step 104, the process may proceed to step 106 to receive expected material placement data. In one embodiment, receiving expected material placement data may include receiving electronic data indicative of at least one of an expected material placement rate or an expected material placement quantity associated with each paving machine of machine system 10. For example, the electronic data may include data indicative of an expected "X" cubic meters of paving material placed per hour, or an expected material placement quantity of "Y" total kilograms of paving material, etc. Expected material placement data will thus typically be based on mechanical attributes of a paving system such as theoretical maximum or minimum paving speeds of one or more paving machines of paving system 10, and may also be based on attributes of the specific work site such as length and width of a surface to be paved, mat or lift thickness, material type, surface grade, ambient temperature, and a host of other factors known by those skilled in the art to affect a quantity of material placed by a paving machine or a rate of material placement. It should further be appreciated that the expected material placement data may be unique to paving machines of a particular configuration or paving machines operating under particular circumstances.

For instance, a paving machine placing paving material on a curving roadbed or a slope might be expected to operate at a different material placement rate than a paving machine paving a straight, level surface. Similarly, a paving machine paving a mat of a particularly wide width may place material at a different rate or at a different total quantity than a paving machine paving material in a mat of a relatively narrower width. Further still, the internal mechanisms of a paving machine such as the feed rate of conveyer 20 in paving machine 12 may affect the expected material placement data. It should thus be appreciated that expected material placement data may include a variety of material placement parameters, and may vary among paving systems. The expected material placement data may further include a calculated material placement amount and/or rate which is estimated or determined on-board paving machine 12 by electronic control unit 40 responsive to the site data. Known techniques such as mapping work surface S with a machine mounted system may be used to gather the site data which, in conjunction with data specific to the machines of paving system 10 as described herein, may be used to determine expected material placement quantity, rate, etc.

From step 106, the process may proceed to step 108 to plan material delivery times, material delivery quantities and material delivery locations based on the site data and expected material placement data. Step 108 may further be understood as establishing a material delivery/supply plan for replenishing first supply volume 14 based in part on the expected material placement data. Establishing a material delivery/supply plan may also include planning material delivery times, etc. for delivering material to additional paving machines of machine system 12. In one embodiment, at or prior to step 108, expected position data indicative of an expected position of one or more paving machines of paving system 10 and an expected position of supply machines 60*a* and 60*b* at certain times during paving surface S may be received. Expected positions may be based on an expected progress rate, such as expected average travel speed of paving machine 12. Establishing the material delivery/supply plan may further include establishing the material delivery plan based also in part on the expected position data. It may thus be appreciated that, at step 108, a variety of different plan parameters may be selected, and a plan established for which machines should be positioned at, or traveling to, what locations, at certain times, to deliver certain quantities of material. The material delivery plan may thus include one or more time terms, position terms, and material quantity terms. As will be further apparent from the following description, establishing the material delivery plan may be understood as establishing a preliminary material delivery/supply plan which is expected to be updated as paving progresses at the work site.

From step 108, the process may proceed to step 112 to commence paving. From step 112, the process may proceed to step 114 to track paving machine locations or positions. As explained above, in some systems multiple paving machines may be used, whereas in other systems such as paving system 10 a single paving machine may be used. From step 114, the process may proceed to step 116 to track material usage by paving machine 12 of paving system 10. In one embodiment, tracking material usage may include tracking a quantity of material which is used by paving machine 12, such as a total amount of material which has been placed thereby. In other instances, tracking material usage in step 116 might include tracking a rate of material usage by paving machine 12, and such other paving machines as may be used in paving system 10. Tracking material usage may be further understood as receiving actual material placement data for paving machine 12. In some instances, the actual material placement data may include electronic data indicative of a non-uniform actual material placement rate, such as might be expected in paving surface S, where paving width changes for subsection T.

From step 116, the process may proceed to step 118 to query whether any windrow needs replenishing soon. It is assumed at this point that a windrow such as windrow $W_1$ has been previously provided prior to commencing paving. At step 118, electronic control unit 40 may be understood as determining, based on the previously established material delivery plan, whether any paving machine of machine system 10 is expected to approach a predefined pick-up location or windrow start location within a predefined period of time. FIG. 1 illustrates a first pick-up location $P_1$, which was previously determined in step 108. At step 118 electronic control unit 40 may be understood as determining whether actions need to be initiated to replenish paving material to paving machine 12, or another paving machine. If no, the process may proceed to step 122 to alert a host computer, or the process could loop back to an earlier point in the control routine. If, at step 118, a windrow is determined to need replenishing soon, the process may proceed to step 120.

At step 120, electronic control unit 40 may query whether supply machines such as supply machines 60*a* and 60*b* can be located. If no, the process may proceed to step 122 to alert the host computer. If yes, the process may proceed to step 124 to compare the supply machine locations with planned delivery locations. From step 124, the process may proceed to step 126 to receive material quantity data from a first supply machine such as supply machine 60*a*. From step 126, the process may proceed to step 128 to receive material quantity data from a second supply machine such as supply machine 60*b*. Supply machine 60*a* might output signals indicating it has a full material load $M_1$, whereas supply machine 60*b* might output signals indicating it has only a partial material load $M_2$. From step 128, the process may proceed to step 130 to compare the material quantity data from supply machines 60*a* and 60*b* with the plan data. In other words, at step 130 electronic control unit 40 may be determining a difference between a material quantity which is expected to be needed at a predefined location such as $P_1$, and at a predefined time, for replenishing supply volume 14, with a material quantity stored by each of supply machines 60*a* and 60*b*. From step 130, the process may proceed to step 132.

At step 132, electronic control unit 40 may query whether there is a supply machine with sufficient material. If no, the process may proceed to step 136 to alert the host computer. If yes, the process may proceed to step 134 to query whether there is a supply machine which can arrive on time. If no, the process may proceed from step 134 to step 136 to alert the host computer. If there is a supply machine which can arrive on time at step 134, the process may proceed to step 138 to select a supply machine. Selecting a supply machine, such as selecting one of supply machines 60*a* and 60*b* may include selecting a supply machine based on the material quantity contained within the corresponding storage container 62*a* or 62*b*, and may also take place based on the relative proximity of the available supply machines to paving machine 12. In some instances, it might be desirable to deliver material from one of supply machines 60*a* and 60*b*, even if the quantity of material is less than the quantity of material called for by the material delivery plan, if the respective supply machine is in close proximity to paving machine 12. Similarly, a supply machine which contains an excess quantity of material, more than what is called for by the material delivery plan, might be selected if it is determined that the material supply machine could drop the excess material at a second delivery location in close proximity to the delivery location for paving machine 12.

From step 138, the process may proceed to step 140 to query whether the selected supply machine needs to deliver at its current location. In other words, at step 140 electronic control unit 40 may be determining whether a supply machine might be in the process of or about to deliver material at its current location, and thus might not be available for replenishing material to paving machine 12. If, at step 140, the selected supply machine needs to deliver at its current location, the process may proceed to step 142 to flag the selected supply machine as unavailable, and may thenceforth return to execute steps 132-140 again. If the selected supply machine does not need to deliver at its current location at step 140, the process may proceed to step 144 to output a dispatching signal to the selected supply machine. The selected supply machine may travel to the planned supply location responsive to the dispatching signal. From step 144, the process may proceed to step 146 to query whether the windrow needs replenishing now. If no, the process may proceed to step 148 to idle the selected supply machine and alert the host computer. If at step 146 the windrow needs replenishing now, the process may proceed to step 150 to receive actual material placement data.

In step 150, electronic control unit 40 may be understood as receiving actual material placement data corresponding to an actual quantity of material placed by paving machine 12 or an actual material placement rate of paving machine 12, as described herein. From step 150, the process may proceed to step 152 where data processor 42 compares the expected material placement data with the actual material placement data. From step 152, the process may proceed to step 154 to output a signal responsive to comparing expected material placement data with the actual material placement data. In one embodiment, the signal may correspond to a difference between the expected material placement data and the actual material placement data, such as an arithmetic difference between an expected material placement quantity and an actual material placement quantity. From step 154, the process may proceed to step 156 to query whether the planned delivery amount will overfill the hopper. If yes, the process may proceed to step 160 to output a plan updating signal. If no, the process may proceed to step 158 to query whether the planned delivery will underfill the hopper. If yes, the process may proceed to step 160. If no, the process may proceed to step 162. If planned material delivery of a given quantity will overfill or underfill hopper 22, electronic control unit 40 may output a plan updating signal at step 160. Outputting the plan updating signal may update the previously determined material supply control algorithm. Updating the material delivery/supply plan may include updating an originally planned delivery location and/or an originally planned delivery quantity. Updating the material delivery/supply plan may further include updating a material quantity term, a machine position term, or a material delivery time term of the material delivery/supply plan. Each of these potential actions may be understood as inhibiting overfilling or underfilling hopper 22, as the case may be, since changing material delivery quantity, material delivery location or material delivery time can be used to control an amount of material which will exist in external supply volume 14 at any one time.

From either of step 158 or step 160, the process may proceed to step 162 to output control commands from the host computer such as electronic control unit 40 to the selected supply machine such as supply machine 60*a* based on the current material delivery/supply plan. Thus, at step 162, electronic control unit 40 is calculating control commands based on the current material delivery/supply plan, whether it be the updated plan or the original, preliminary plan as discussed above. The outputted control commands may include supply machine control signals. From step 162, the process may proceed to step 164 to actuate the material discharge mechanism of the selected supply machine responsive to the control commands. The selected supply machine, and/or control system 32 may be tracking supply machine location, and hence controlling material discharge responsive also to supply machine position signals. From step 164, the process may proceed to step 166 to receive sensor feedback from the material discharge mechanism indicative of material discharge quantity. From step 166, the process may proceed to step 168 to query whether the sensor feedback validates that the correct amount of material was delivered. If no, the process may proceed to step 170 to alert the host computer. From step 170, the process may proceed to step 172 to query whether there is a need for manual intervention. If yes, the process may proceed from step 172 to step 174 to display an alert to the paving machine operator via display 38, for example. If no, the process may proceed ahead to step 178. If, at step 168, the sensor feedback validates that the correct amount was delivered, the process may proceed to step 176 to output a plan validation signal. From step 176, the process may proceed to step 178 to display an anticipated next delivery location to the supply machine operator. From step 178, the process may proceed to step 180 to End.

Figure 4:
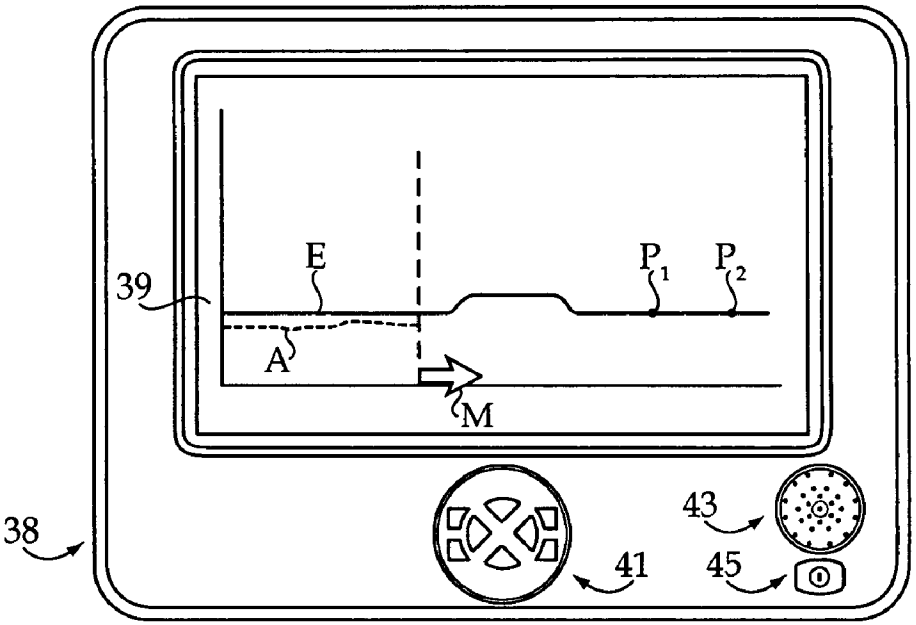
FIG. 4 is a diagrammatic illustration of a display for the machine system of FIGS. 1 and 2, shown in an example display state.

Referring to FIG. 4, there is shown display 38 of control system 32, in an example display state. Display 38 may include a display screen 39 which is configured to display graphs, illustrations, alerts, etc., to an operator of paving machine 12, or to other personnel, for monitoring activities of machine system 10 in real time. In the example display state shown, paving machine 12 is shown approximately in the same relative location on surface S as that depicted in FIG. 2. It should be appreciated that the illustration of display 38 in FIG. 4 represents one practical example of how certain data acquired and processed during executing the control algorithm described above may be communicated to an operator. Thus, while the flowchart of FIGS. 3*a-d* represents by way of example certain of the automated functions which take place during operating machine system 10, FIG. 4 represents incorporation of monitoring and control by a human operator. It should be appreciated, however, that in certain embodiments, the automated actions of machine system 10 may take place in a manner transparent to an operator, whereas in other instances such as that presently described, at least certain proposed automated actions may be considered and confirmed or rejected by an operator.

Display 38 may also include a power button 45, a speaker 43, and a keypad 41 or the like. In one embodiment, display 38 may display information to an operator of paving machine 12 such as expected material placement amount via a curve "E", an actual material placement amount via a curve "A" and an approximate paving machine position "M" relative to a start location "Q" on surface S. Based on a difference between curves E and A, display 38 may thus provide to an operator an approximation of a difference between an expected material placement amount or material placement rate and an actual material placement amount or material placement rate. Display 38 may also indicate to an operator a proximity of machine 12 to certain features of surface S, such as the enlarged width subsection T. Accordingly, an operator is provided a display representation of paving machine location, expected material placement quantity or rate, actual material placement quantity or rate and indications of upcoming expected changes in material placement. Display 38 may be coupled with electronic control unit 40, and thus its display state may be continually updated.

By viewing display 38 as shown in FIG. 4, an operator may readily understand that paving machine 12 is placing less material than expected, given the difference between curves E and A. The operator will also understand that an increase in paving material supply is expected, corresponding to the increase in the mass quantity profile of windrow $W_1$ prior to enlarged subsection T of surface S. Display 38 may also convey to an operator an approximate proximity to a planned windrow start location $P_1$. It will be recalled that windrow start location $P_1$ represents an initially planned windrow start location where a supply machine is to start a windrow on surface S for replenishing material to external supply volume 14. Given that paving machine 12 is placing less material than expected, and an increase in the material supply is expected soon, an operator and/or electronic control unit 40 might conclude based on the display state of display 38 in FIG. 4, that a possibility of overfilling hopper 22 exists if replenishing external material supply volume 14 proceeds as originally planned. Specific alert signals might be communicated to display 38 from electronic control unit 40, such as audible alerts to speaker 43 or visual alerts on display screen 39.

It will be recalled that electronic control unit 40 may determine based on comparing expected material placement data with actual material placement data whether a likelihood of overfilling or underfilling hopper 22 exists. If, in the scenario depicted in FIG. 4, overfilling hopper 22 is likely to occur, electronic control unit 40 may decide to update the material delivery plan such that material delivery takes place at a different location than a previously planned location. It will further be recalled that execution of a material delivery/supply control algorithm as discussed above contemplates establishing a preliminary material delivery plan. In the present scenario, the original delivery location or windrow start location was planned to be at point $P_1$. Since it appears that overfilling hopper 22 is likely if delivery takes place as originally planned, electronic control unit 40 may output a plan updating signal, updating the material delivery plan based on operation of machine system 10 in real time. In one embodiment, the plan updating signal may change the originally planned delivery location to a new location, corresponding to location $P_2$ as shown on display screen 39. An icon such as an arrow "V" on display screen 39 or some other operator perceptible alert may be used to notify the operator that a new windrow start location has been selected. In one embodiment, operator confirmation of the selection of the new windrow start location may take place via inputting a confirmation command via keypad 41.

Once confirmation of the updated plan and updated windrow start location is received from the operator, electronic control unit 40 may initiate the steps necessary to control discharging material onto surface S with a supply machine to replenish external supply volume 14 according to the updated plan. FIG. 2 illustrates supply machine 60*a* delivering material at the updated windrow start location $P_2$. If underfilling hopper 22 were determined to be likely, the updated material delivery location might be relatively closer to paving machine 12. It will further be recalled that in addition to or instead of updating material delivery locations, the material delivery quantity may be updated based on real time data. Thus, in the scenario described in connection with FIG. 4, an operator might also confirm an updated material quantity term. Other aspects of operating machine system 10 could also integrate monitoring and control by a human operator, such as validating a material delivery plan. For example, an operator could be provided various data via display 38 such as yet another curve indicating a quantity of material discharged via supply machine 60*a*. The operator could, based on the display data, confirm that planned material delivery quantities, times, locations, etc., were reasonably close to what was actually needed, confirm that no manual intervention was required, etc. In each of these cases, confirmation or rejection of plan parameters could be used to tailor the material delivery algorithm for use in subsequent control of machine system 10.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A method of operating a machine system comprising the steps of:

receiving expected material placement data for a paving machine adapted to receive material from a first supply volume external to the paving machine, transfer the material through a second supply volume internal to the paving machine and place the material on a work surface via a material placing mechanism of the paving machine, the expected material placement data being indicative of at least one of a quantity of the material expected to be placed on the work surface and a rate at which the material is expected to be placed on the work surface;

receiving actual material placement data for the paving machine, the actual material placement data being indicative of at least one of a quantity of the material which has been placed on the work surface and a rate at which the material was placed on the work surface;

outputting a signal based on a comparison between the expected material placement data and the actual material placement data; and commanding replenishing material from a supply machine to the first supply volume responsive to the signal, and such that at least one of a planned replenishment time, location, and quantity is changed based on a difference between the expected material placement data and the actual material placement data.

2. The method of claim 1 wherein the step of receiving actual material placement data further includes receiving electronic data indicative of a non-uniform actual material placement rate by the paving machine which differs from an expected material placement rate, and wherein the step of outputting a signal further includes outputting a signal which is based on a difference between the expected material placement rate and the non-uniform actual material placement rate.

3. The method of claim 1 wherein the step of commanding further includes commanding discharging a paving material from the supply machine onto the work surface for pick-up by the paving machine.

4. The method of claim 3 wherein the second supply volume includes a windrow of paving material on the work surface, the method further comprising the steps of replenishing the windrow via the commanding step and loading a hopper of the paving machine with paving material from the windrow.

5. The method of claim 4 wherein the step of replenishing the windrow via the commanding step further includes controlling at least one of, a start location of the windrow, a stop location of the windrow and a mass quantity profile of the windrow, and further comprising a step of inhibiting at least one of overfilling and underfilling the hopper with paving material from the windrow via the replenishing step.

6. The method of claim 1 further comprising the steps of receiving expected position data indicative of an expected position of the paving machine, and establishing a material delivery plan for replenishing the first supply volume based in part on the expected material placement data and in part on the expected position data.

7. The method of claim 6 further comprising the steps of receiving position data indicative of an actual position of the paving machine relative to the expected position, and updating the material delivery plan responsive to a comparison between the expected position and the actual position and responsive to the comparison between the expected material placement data and the actual material placement data.

8. The method of claim 7 wherein the step of commanding further includes commanding replenishing the second supply volume according to the updated material delivery plan at least in part via commanding actuating a material discharge control mechanism of the supply machine responsive to the signal.

9. The method of claim 6 wherein the step of establishing a material delivery plan further includes a step of establishing a material quantity term, and wherein the step of updating the material delivery plan further includes updating the material quantity term.

10. The method of claim 8 further comprising the steps of receiving material discharge data indicative of a discharge quantity of material from the supply machine, and outputting a plan validation signal responsive to the material discharge data.

11. The method of claim 1 further comprising the steps of:

receiving position data for a plurality of different supply machines;

receiving on-board material quantity data for each of the plurality of supply machines; and selecting one of the plurality of supply machines for replenishing the first supply volume responsive to the position data and the on-board material quantity data;

wherein the step of commanding includes commanding replenishing the first supply volume via the selected supply machine.

12. A machine system comprising:

a paving machine including a frame, a plurality of ground engaging elements, a hopper, a conveying mechanism and a material placing mechanism, the material placing mechanism being adapted to receive a material from the hopper via the conveying mechanism for placing the material on a work surface, the paving machine further including an internal material supply volume for the machine system defined in part by the hopper and in part by the conveying mechanism; and a control system including a computer readable memory configured to store expected material placement data for the paving machine, and a receiver configured to receive actual material placement data for the paving machine;

the expected material placement data being indicative of at least one of a quantity of the material expected to be placed on the work surface and a rate at which the material is expected to be placed on the work surface, and the actual material placement data being indicative of at least one of a quantity of the material which has been placed on the work surface and a rate at which the material was placed on the work surface;

the control system further including a data processor coupled with the computer readable memory and with the receiver, and being configured to compare the expected material placement data with the actual material placement data, and further configured to output a supply machine control signal to control replenishing material via a supply machine to an external material supply volume for the paving machine in a manner responsive to comparing the expected material placement data with the actual material placement data, and such that at least one of a planned replenishment time, location, and quantity is changed based on a difference between the expected material placement data and the actual material placement data.

13. The machine system of claim 12 wherein:

the control system further includes a sensing system resident on the paving machine and configured to output sensor signals to the data processor which are indicative of at least one of, actual material placement rate and actual material placement quantity, during placing material with the paving machine;

the machine system further comprises a supply machine having a material discharge control mechanism which includes a second receiver configured to receive the supply machine control signal; and the control system further includes a second sensing system resident on the supply machine and configured to output sensor signals to the data processor including material discharge quantity data for the supply machine.

14. The machine system of claim 13 wherein the material placing mechanism of the paving machine includes a screed and the sensing system resident on the paving machine includes a screed control sensor, and wherein the material discharge control mechanism of the supply machine includes a discharge gate and the second sensing system includes a gate control sensor.

15. The machine system of claim 13 wherein the computer readable memory stores a material supply control algorithm and the data processor is configured via executing the material supply control algorithm to control placing material in a windrow on the work surface with the supply machine for pick-up by the paving machine, and wherein the material supply control algorithm includes an actual material placement term corresponding to the actual material placement data and a material discharge term corresponding to the material discharge quantity data.

16. The machine system of claim 15 wherein the paving control system further includes a first position sensor resident on the paving machine and configured to receive position signals indicative of a position of the paving machine and a second position sensor resident on the supply machine and configured to receive position signals indicative of a position of the supply machine, wherein the material supply control algorithm further includes a paving machine position term and a supply machine position term and wherein the data processor is further configured via executing the material supply control algorithm to output the supply machine control signal responsive to a position of the paving machine and to a position of the supply machine.

17. A paving control system for a paving system comprising:

a computer readable memory configured to store at least one of expected material placement data indicative of an expected material placement rate and an expected material placement quantity by a paving machine;

a receiver configured to receive actual material placement data for the paving machine indicative of at least one of a quantity of the material which has been placed and a rate at which the material was placed; and a data processor coupled with the computer readable memory and with the receiver, the data processor being configured to compare the expected material placement data with the actual material placement data;

the data processor being further configured to output a control signal to a supply machine to controllably replenish material to an external material supply volume for the paving system in a manner responsive to comparing the expected material placement data with the actual material placement data, and such that at least one of a planned replenishment time, location, and quantity is changed based on a difference between the expected material placement data and the actual material placement data.

18. The paving control system of claim 17 further comprising:

a first receiver configured to receive paving machine position data indicative of a position of the paving machine; and a second receiver configured to receive supply machine position data indicative of a position of the supply machine;

a sensing system configured to output sensor signals including the actual material placement data to the data processor;

wherein the data processor is further configured to output the control signal to the supply machine responsive to a difference between the actual material placement data and the expected material placement data, and responsive to the paving machine position data and to the supply machine position data.

19. The paving control system of claim 18 wherein:

the sensing system includes a first sensing system;

the paving control system further comprises a second sensing system configured to output sensor signals including material discharge quantity data to the data processor, the material discharge quantity data including discharge data for material discharged from the supply machine to the external material supply volume; and the data processor is further configured to output a validation signal responsive to the discharge data.

* * * * *